US005732606A

United States Patent [19]

Chiang

[11] Patent Number: 5,732,606

[45] Date of Patent: Mar. 31, 1998

[54] EXTENDIBLE SCREW DRIVER

[76] Inventor: Shu Chi Chiang, No. 105, Tsu Ah Lane, Sec. 3, Chong San Road, Wu Tz Hsiang, Taichung Hsien, Taiwan

[21] Appl. No.: 717,011

[22] Filed: Sep. 20, 1996

[51] Int. Cl.[6] ..... B25B 23/16

[52] U.S. Cl. ..... 81/177.2; 81/177.6

[58] Field of Search ..... 81/177.2, 177.6, 81/436–440; 403/325, 321, DIG. 6, 109, 377

[56] References Cited

U.S. PATENT DOCUMENTS

| | | | |
|---|---|---|---|
| 1,269,413 | 6/1918 | Finnigan | 81/177.2 |
| 1,493,983 | 5/1924 | Hurley | 81/177.2 |
| 1,753,441 | 4/1930 | Morehouse | 81/177.2 X |
| 2,796,101 | 6/1957 | Hasemann et al. | 81/177.6 X |
| 4,102,375 | 7/1978 | Rossini | 81/177.2 X |
| 4,586,406 | 5/1986 | Howard | 81/177.2 |
| 4,876,929 | 10/1989 | Kozak | 81/177.6 X |
| 5,593,239 | 1/1997 | Sallee | 403/377 X |

*Primary Examiner*—D. S. Meislin
*Attorney, Agent, or Firm*—Charles E. Baxley, Esq.

[57] ABSTRACT

A tool includes tube having a rear portion secured in a handle and having a non-circular bore for slidably receiving an extension and for allowing the extension to be rotated in concert with the tube. The extension includes a retaining ring secured to the rear portion. The tube includes an annular slot for engaging with the retaining ring and for preventing the extension from disengaging from the tube. The extension includes a flexible middle coil for allowing the extension to be bent. A sleeve is rotatably engaged on the front portion of the extension for forming a hand grip.

5 Claims, 4 Drawing Sheets

EXTENDIBLE SCREW DRIVER

BACKGROUND OF THE INVENTION

1. Field of the Invention

The present invention relates to a tool, and more particularly to a screw driver having an extendible driving arm.

2. Description of the Prior Art

Typical tools, such as screw drivers, comprise a beam having a handle secured to one end thereof for driving the beam. The beam includes a predetermined length and may not be extended to longer length. In addition, the screw driver may not be easily used for driving the fastener engaged in a recess.

The present invention has arisen to mitigate and/or obviate the afore-described disadvantages of the conventional screw drivers.

SUMMARY OF THE INVENTION

The primary objective of the present invention is to provide a tool including an extension received in a tube and extendible outward of the tube for increasing the driving length of the screw driver.

The other objective of the present invention is to provide a tool including a flexible extension for driving the fastener engaged in a recess.

In accordance with one aspect of the invention, there is provided a tool comprising a handle, a tube including a rear portion secured in the handle and including a front portion, the tube including a non-circular bore formed therein, an extension slidably received in the non-circular bore of the tube for allowing the extension to move between an outward position and a retracted position, the extension including a non-circular cross section for engaging with the non-circular bore and for allowing the extension to be rotated in concert with the tube, the extension including a front portion having an engaging hole for engaging with a tool bit and includes a rear portion, and means for securing the rear portion of the extension to the front portion of the tube for preventing the extension from disengaging from the tube when the extension is moved to the outward position relative to the tube.

The securing means includes a retaining ring secured to the rear portion of the extension, the tube includes an annular slot formed in an inner peripheral portion of the front portion for engaging with the retaining ring and for preventing the extension from disengaging from the tube.

The front portion and the rear portion of the extension each includes a non-circular cross section for engaging with the non-circular bore and for allowing the extension to be rotated in concert with the tube, the extension includes a flexible coil secured between the front and the rear portions for allowing the extension to be bent.

The front portion of the extension includes an annular swelling and a retaining ring secured thereon, and includes a sleeve rotatably engaged on the front portion of the extension and engaged between the annular swelling and the retaining ring for forming a hand grip.

The front and the rear portions of the tube each includes an annular groove formed therein, the front portion of the tube includes an orifice for receiving a ball and includes a control ferrule rotatably engaged on the front portion of the tube, the control ferrule includes an annular recess formed therein for engaging with the ball and for allowing the ball to be disengaged from the annular grooves of the extension and for allowing the extension to be moved between the outward position and the retracted position, and the ball is forced to engage with the annular grooves for positioning the extension to the tube when the control ferrule is moved relative to the tube and when the annular recess of the control ferrule is disengaged from the ball.

The tube includes a retaining ring secured on the front portion thereof, the control ferrule includes two annular depressions formed therein for engaging with the retaining ring and for positioning the control ferrule to the tube, the retaining ring is engaged in a first of the annular depressions when the annular recess is engaged with the ball, and the retaining ring is engaged in a second of the annular depressions when the annular recess is disengaged from the ball.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
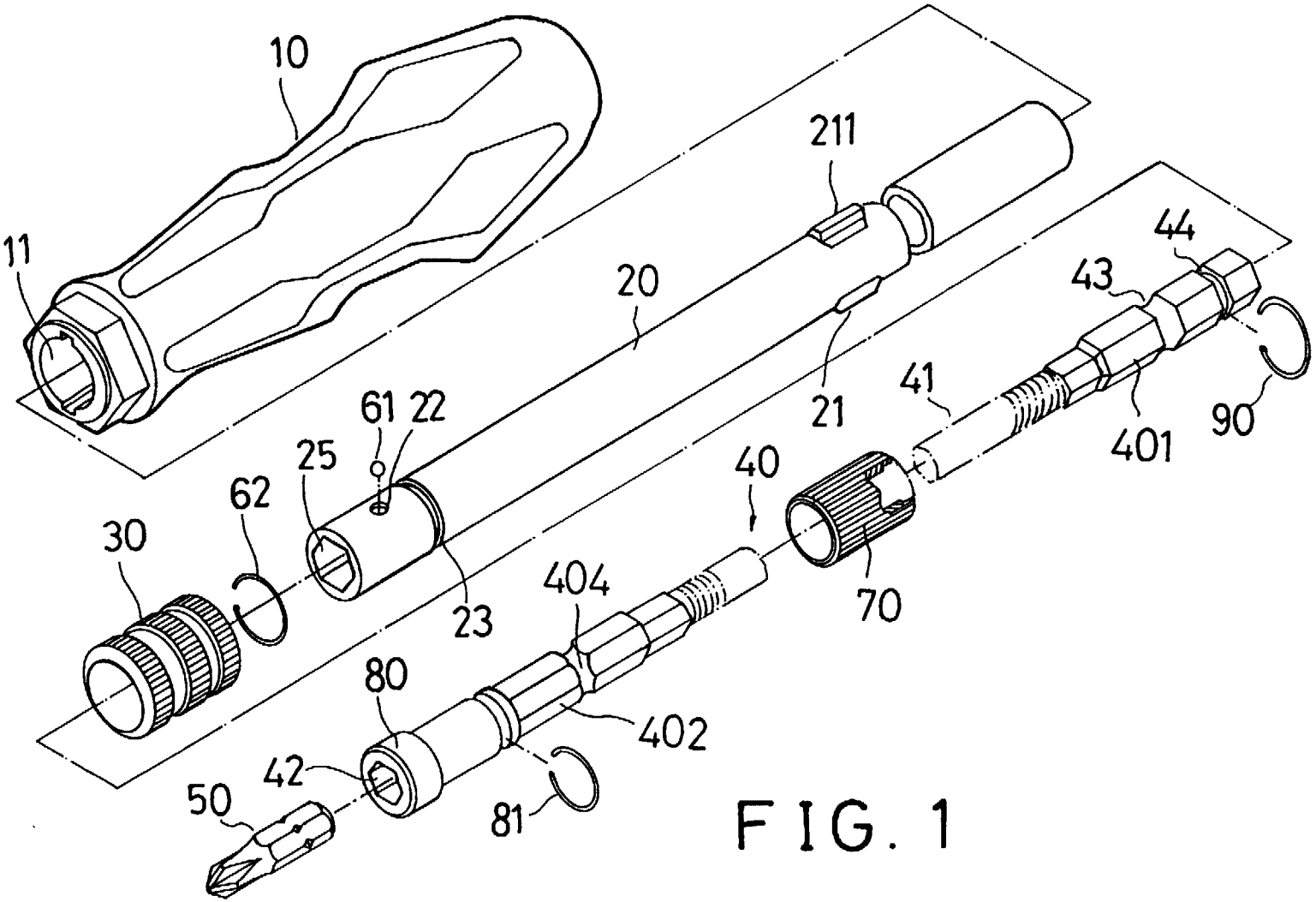
FIG. 1 is an exploded view of a screw driver in accordance with the present invention.
Figure 2:
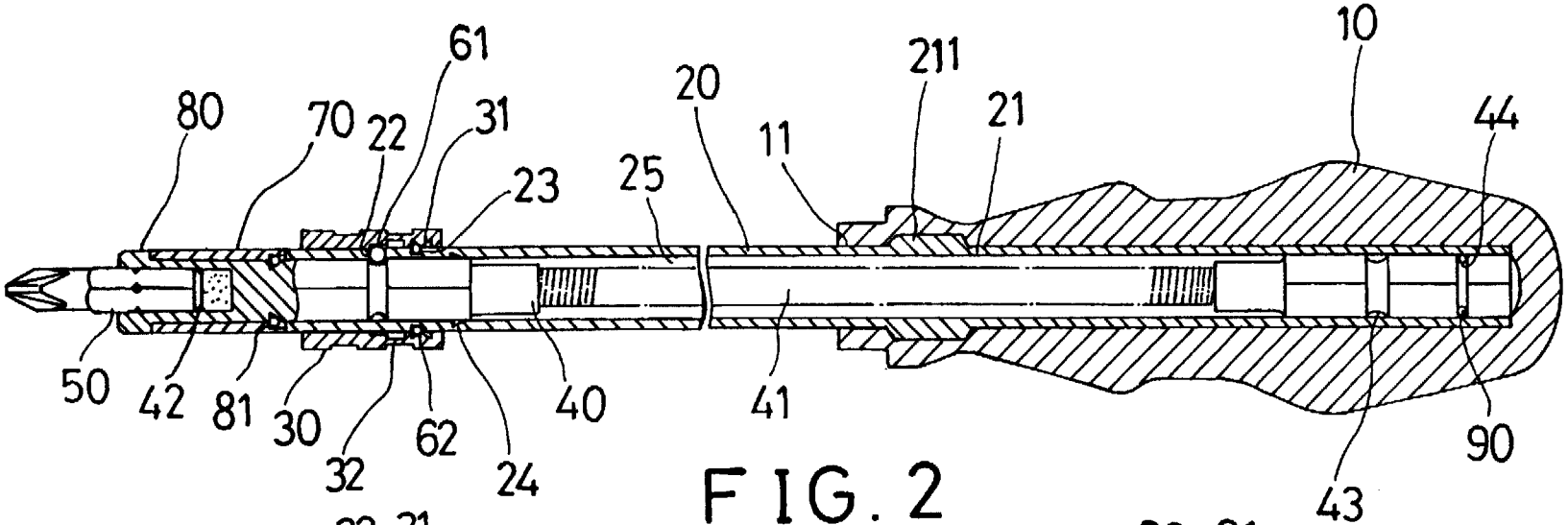
FIG. 2 is a cross sectional view of the screw driver.
Figure 5:
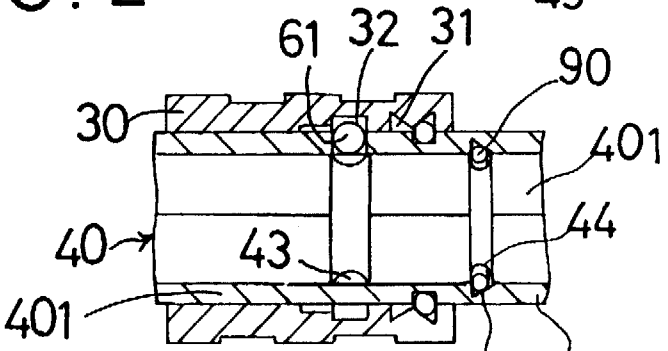
FIGS. 4 and 5 are enlarged partial cross sectional views illustrating the operation of the screw driver.
Figure 4:
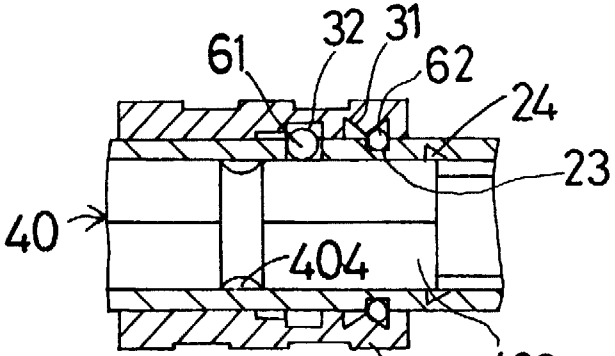
Figure 3:
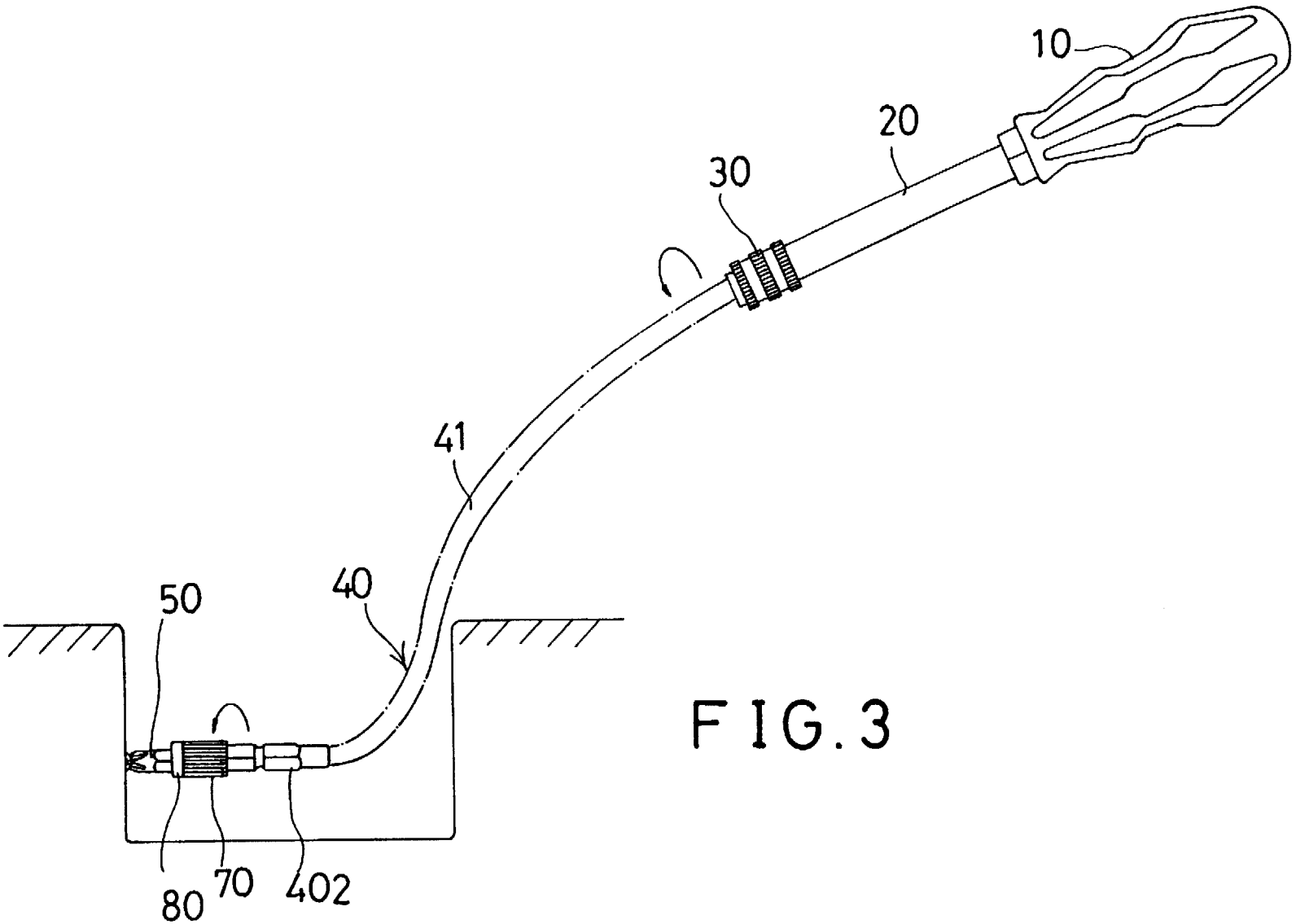
FIG. 3 is a plane view illustrating the operation of the screw driver, in which the extension is extended outward of the tube.

Referring to the drawings, and initially to FIGS. 1 to 5, a screw driver in accordance with the present invention comprises a handle 10 including a hole 11 formed therein for receiving the rear portion 21 of a tube 20 which includes one or more bulges 211 for engaging with the handle 10 and for secured to the handle 10. The tube 20 includes a bore 25 having a non-circular cross section, such as hexagonal cross section. The tube 20 includes an annular groove 23 formed in the front portion for engaging with a retaining ring 62 and includes an orifice 22 for receiving a ball 61 therein. The tube 20 includes an annular slot 24 formed in the inner peripheral portion of the front portion thereof (FIGS. 2 and 4, 5).

An extension 40 is received in the bore 25 of the tube 20 and includes a front portion 402 and a rear portion 401 each having a non-circular cross section for engaging with the non-circular bore 25 and for allowing the extension 40 to be rotated in concert with the tube 20. The extension 40 includes a flexible coil 41 secured between the front and the rear portions 402, 401 for allowing the extension 40 to be bent, best shown in FIG. 3. The rear portion 401 of the extension 40 includes an annular groove 44 formed therein for engaging with a retaining ring 90 which may engage with the annular slot 24 of the tube 20 (FIG. 5) when the extension 40 is pulled outward of the tube 20, so as to prevent the extension 40 from disengaging from the tube 20. The rear portion 401 of the extension 40 includes another annular groove 43 for engaging with the ball 61 and for positioning the extension 40 relative to the tube 20. The front portion 402 of the extension 40 includes an engaging hole 42 for engaging with the tool bit 50 and includes an annular swelling 80 for engaging with a sleeve 70 and includes a retaining ring 81 secured thereon for engaging with the sleeve 70 and for rotatably securing the sleeve 70 on the front portion 402 of the extension 40. The user may grasp the sleeve 70 when the extension 40 is rotated by the handle 10. The front portion 402 of the extension 40 includes an annular groove 404 for engaging with the ball 61 (FIG. 4).

A control ferrule 30 is engaged on the front end of the tube 20 and includes an annular recess 32 formed therein for engaging with the ball 61 and for allowing the ball 61 to be disengaged from the annular grooves 404, 43 and for allowing the extension 40 to be pulled outward of the tube 20. The control ferrule 30 further includes two annular depressions 31 formed in the inner peripheral portion for engaging with the retaining ring 62 and for positioning the control ferrule 30 relative to the tube 20. The retaining ring 62 may be engaged in either of the annular depressions 31 for limiting the relative movement between the control ferrule 30 and the tube 20.

In operation, as shown in FIG. 4, when the retaining ring 62 is engaged with the rear annular depression 31, the ball 61 is engaged in the annular recess 32 and is allowed to be disengaged from the annular groove 404 (FIG. 4) or 43 (FIG. 5) such that the extension 40 may be pulled outward of the tube 20 until the retaining ring 90 is engaged with the annular slot 24 of the tube (FIG. 5). When the control ferrule 30 is moved relative to the tube 20 for engaging the retaining ring 62 with the front annular depression 31, the ball 61 may be forced to move inward of the tube 20 to engage with the annular groove 404 (FIG. 2) when the extension 40 is engage in the tube 20, or to engage with the annular groove 43 when the extension 40 is pulled outward of the tube 20. Accordingly, the ball 61 may position the extension 40 relative to the tube 20 at the outward extended position and at the retracted position respectively.

Figure 7:
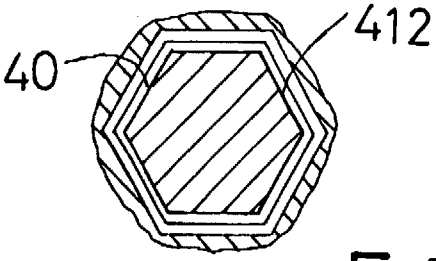
FIG. 7 is an enlarged cross sectional view taken along lines 7—7 of FIG. 6.
Figure 6:
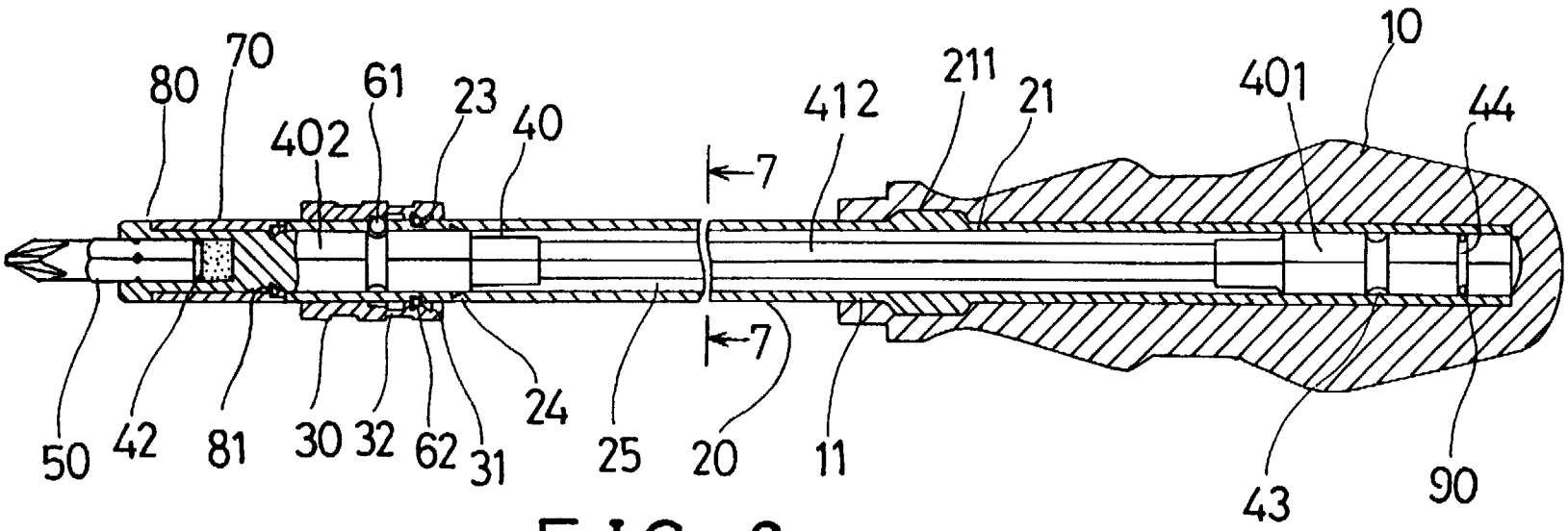
FIG. 6 is a cross sectional view illustrating another application of the screw driver.

Referring next to FIGS. 6 and 7, alternatively, the extension 40 may include a solid beam 412 secured between the front and the rear portions 402, 401. The extension 40 may also be pulled outward of the tube 20 for increasing the driving arm of the screw driver.

Accordingly, the screw driver in accordance with the present invention includes an extension which may be extended outward of the tube for increasing the driving arm of the screw driver. In addition, the screw driver may include a flexible extension for allowing the screw driver to have a curved driving arm and for driving the fastener engaged in a recess.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle, a tube including a rear portion secured in said handle and including a front portion, said tube including a non-circular bore formed therein, an extension slidably received in said non-circular bore of said tube for allowing said extension to move between an outward position and a retracted position, said extension including a non-circular cross section for engaging with said non-circular bore and for allowing said extension to be rotated in concert with said tube, said extension including a front portion having an engaging hole for engaging with a tool bit and includes a rear portion, said front portion of said extension including an annular swelling and a retaining ring secured thereon and including a sleeve rotatably engaged on said front portion of said extension and engaged between said annular swelling and said retaining ring for forming a hand grip, and means for securing said rear portion of said extension to said front portion of said tube for preventing said extension from disengaging from said tube when said extension is moved to said outward position relative to said tube.

2. A tool according to claim 1, wherein said securing means includes a retaining ring secured to said rear portion of said extension, said tube includes an annular slot formed in an inner peripheral portion of said front portion for engaging with said retaining ring and for preventing said extension from disengaging from said tube.

3. A tool according to claim 1, wherein said front portion and said rear portion of said extension each includes a non-circular cross section for engaging with said non-circular bore and for allowing said extension to be rotated in concert with said tube, said extension includes a flexible coil secured between said front and said rear portions for allowing said extension to be bent.

4. A tool according to claim 1, wherein said front and said rear portions of said extension each includes an annular groove formed therein, said front portion of said tube includes an orifice for receiving a ball and includes a control ferrule rotatably engaged on said front portion of said tube, said control ferrule includes an annular recess formed therein for engaging with said ball and for allowing said ball to be disengaged from said annular grooves of said extension and for allowing said extension to be moved between said outward position and said retracted position, and said ball is forced to engage with said annular grooves for positioning said extension to said tube when said control ferrule is moved relative to said tube and when said annular recess of said control ferrule is disengaged from said ball.

5. A tool comprising:

a handle, a tube including a rear portion secured in said handle and including a front portion, said tube including a non-circular bore formed therein, and said tube including a retaining ring secured on said front portion thereof, an extension slidably received in said non-circular bore of said tube for allowing said extension to move between an outward position and a retracted position, said extension including a non-circular cross section for engaging with said non-circular bore and for allowing said extension to be rotated in concert with said tube, said extension including a front portion having an engaging hole for engaging with a tool bit and including a rear portion, said front and said rear portions of said extension each including an annular groove formed therein, said front portion of said tube including an orifice for receiving a ball and including a control ferrule rotatably engaged on said front portion of said tube, said control ferrule including an annular recess formed therein for engaging with said ball and for allowing said ball to be disengaged from said annular grooves of said extension and for allowing said extension to be moved between said outward position and said retracted position, and said ball being forced to engage with said annular grooves for positioning said extension to said tube when said control ferrule is moved relative to said tube and when said annular recess of said control ferrule is disengaged from said ball, and means for securing said rear portion of said extension to said front portion of said tube for preventing said extension from disengaging from said tube when said extension is moved to said outward position relative to said tube, said control ferrule including two annular depressions formed therein for engaging with said retaining ring and for positioning said control ferrule to said tube, said retaining ring being engaged in a first of said annular depressions when said annular recess is engaged with said ball, and said retaining ring being engaged in a second of said annular depressions when said annular recess is disengaged from said ball.

* * * * *